US012011807B2

(12) United States Patent
Eckel et al.

(10) Patent No.: US 12,011,807 B2
(45) Date of Patent: Jun. 18, 2024

(54) SHAPED ABRASIVE PARTICLE TRANSFER ASSEMBLY

(71) Applicant: 3M INNOVATIVE PROPERTIES COMPANY, St. Paul, MN (US)

(72) Inventors: Joseph B. Eckel, Vadnais Heights, MN (US); Aaron K. Nienaber, Lake Elmo, MN (US); Thomas J. Nelson, Woodbury, MN (US); Amelia W. Koenig, Minneapolis, MN (US); Ann M. Hawkins, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 207 days.

(21) Appl. No.: 17/415,150

(22) PCT Filed: Dec. 17, 2019

(86) PCT No.: PCT/IB2019/060934

§ 371 (c)(1),
(2) Date: Jun. 17, 2021

(87) PCT Pub. No.: WO2020/128842

PCT Pub. Date: Jun. 25, 2020

(65) Prior Publication Data

US 2022/0055187 A1 Feb. 24, 2022

Related U.S. Application Data

(60) Provisional application No. 62/781,072, filed on Dec. 18, 2018.

(51) Int. Cl.

| | |
|---|---|
| ***B24D 18/00*** | (2006.01) |
| ***B24D 3/00*** | (2006.01) |
| ***B24D 3/28*** | (2006.01) |

(52) U.S. Cl.

CPC ..... *B24D 18/0072* (2013.01); *B24D 3/004* (2013.01); *B24D 3/28* (2013.01)

(58) Field of Classification Search

CPC ..... B24D 18/0072; B24D 3/004; B24D 3/28

See application file for complete search history.

(56) References Cited

U.S. PATENT DOCUMENTS

| | | | |
|---|---|---|---|
| 1,910,444 | A | 5/1933 | Nicholson |
| 2,141,658 | A | 12/1938 | Melton |

(Continued)

FOREIGN PATENT DOCUMENTS

| | | |
|---|---|---|
| EP | 1207015 | 5/2002 |
| EP | 3086903 | 7/2015 |

(Continued)

OTHER PUBLICATIONS

International Search Report for PCT International Application No. PCT/IB2019/060613, mailed on Feb. 21, 2020, 4 pages.

(Continued)

*Primary Examiner* — Pegah Parvini

(74) *Attorney, Agent, or Firm* — Aleksander Medved

(57) ABSTRACT

Various embodiments of the present disclosure relate to a shaped abrasive particle transfer assembly. The shaped abrasive particle transfer assembly includes a substrate including an adhesive and a plurality of shaped abrasive particles adhered to the substrate and forming a predetermined pattern thereon.

6 Claims, 6 Drawing Sheets

(56) References Cited

U.S. PATENT DOCUMENTS

| | | | | |
|---|---|---|---|---|
| 3,041,156 | A | 6/1962 | Rowse | |
| 3,058,819 | A | 10/1962 | Paulson | |
| 3,616,580 | A | 11/1971 | Dewell | |
| 3,676,092 | A | 7/1972 | Buell | |
| 3,729,873 | A | 5/1973 | Sandell | |
| 3,784,365 | A | 1/1974 | Caserta | |
| 3,833,346 | A | 9/1974 | Wirth | |
| 3,868,232 | A | 2/1975 | Sioui | |
| 3,869,834 | A | 3/1975 | Mullin | |
| 4,215,516 | A | 8/1980 | Huschle | |
| 4,314,827 | A | 2/1982 | Leitheiser | |
| 4,475,926 | A | 10/1984 | Hickory | |
| 4,623,364 | A | 11/1986 | Cottringer | |
| 4,652,275 | A | 3/1987 | Bloecher | |
| 4,734,104 | A | 3/1988 | Broberg | |
| 4,737,163 | A | 4/1988 | Larkey | |
| 4,744,802 | A | 5/1988 | Schwabel | |
| 4,751,138 | A | 6/1988 | Tumey | |
| 4,770,671 | A | 9/1988 | Monroe | |
| 4,799,939 | A | 1/1989 | Bloecher | |
| 4,881,951 | A | 11/1989 | Wood | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,078,753 | A | 1/1992 | Broberg | |
| 5,085,671 | A | 2/1992 | Martin | |
| 5,152,917 | A | 10/1992 | Pieper | |
| 5,201,916 | A | 4/1993 | Berg | |
| 5,203,884 | A | 4/1993 | Buchanan | |
| 5,213,591 | A | 5/1993 | Celikkaya | |
| 5,269,821 | A | 12/1993 | Helmin | |
| 5,352,254 | A | 10/1994 | Celikkaya | |
| 5,366,523 | A | 11/1994 | Rowenhorst | |
| 5,378,251 | A | 1/1995 | Culler | |
| 5,417,726 | A | 5/1995 | Stout | |
| 5,435,816 | A | 7/1995 | Spurgeon | |
| 5,436,063 | A | 7/1995 | Follett | |
| 5,453,106 | A | 9/1995 | Roberts | |
| 5,496,386 | A | 3/1996 | Broberg | |
| 5,498,268 | A | 3/1996 | Gagliardi | |
| 5,520,711 | A | 5/1996 | Helmin | |
| 5,609,706 | A | 3/1997 | Benedict | |
| RE35,570 | E | 7/1997 | Rowenhorst | |
| 5,672,097 | A | 9/1997 | Hoopman | |
| 5,766,277 | A | 6/1998 | DeVoe | |
| 5,946,991 | A | 9/1999 | Hoopman | |
| 5,954,844 | A | 9/1999 | Law | |
| 5,961,674 | A | 10/1999 | Gagliardi | |
| 5,975,987 | A | 11/1999 | Hoopman | |
| 5,975,988 | A | 11/1999 | Christianson | |
| 5,984,988 | A | 11/1999 | Berg | |
| 6,077,601 | A | 6/2000 | DeVoe | |
| 6,129,540 | A | 10/2000 | Hoopman | |
| 6,228,133 | B1 | 5/2001 | Thurber | |
| 7,553,346 | B2 | 6/2009 | Welygan | |
| 8,034,137 | B2 | 10/2011 | Erickson | |
| 8,080,072 | B2 | 12/2011 | Woo | |
| 8,142,531 | B2 | 3/2012 | Adefris | |
| 8,142,532 | B2 | 3/2012 | Erickson | |
| 8,142,891 | B2 | 3/2012 | Culler | |
| 9,017,150 | B2 | 4/2015 | Keipert | |
| 9,440,332 | B2 | 9/2016 | Gaeta | |
| 9,457,453 | B2 | 10/2016 | Seth | |
| 9,604,346 | B2 | 3/2017 | Breder | |
| 9,776,302 | B2 | 10/2017 | Keipert | |
| 9,969,057 | B2 | 5/2018 | Eugster | |
| 2001/0003884 | A1 | 6/2001 | Wei | |
| 2004/0098923 | A1* | 5/2004 | Hood | B24D 11/005 51/296 |
| 2009/0165394 | A1 | 7/2009 | Culler | |
| 2009/0169816 | A1 | 7/2009 | Erickson | |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0344786 | A1 | 12/2013 | Keipert | |
| 2014/0106126 | A1 | 4/2014 | Gaeta | |
| 2014/0290147 | A1 | 10/2014 | Seth | |
| 2015/0224629 | A1 | 8/2015 | Moren | |
| 2015/0291866 | A1 | 10/2015 | Arcona | |
| 2016/0311081 | A1 | 10/2016 | Culler | |
| 2016/0311084 | A1* | 10/2016 | Culler | B24D 18/0054 |
| 2016/0315081 | A1 | 10/2016 | Park | |
| 2017/0050293 | A1* | 2/2017 | Gaeta | B24D 18/0072 |
| 2017/0225299 | A1 | 8/2017 | Keipert | |
| 2017/0368667 | A1 | 12/2017 | Keipert | |
| 2018/0029194 | A1 | 2/2018 | Keipert | |
| 2018/0086957 | A1 | 3/2018 | Sahlin | |

FOREIGN PATENT DOCUMENTS

| | | |
|---|---|---|
| EP | 3319758 | 1/2017 |
| WO | WO 2003-008151 | 1/2003 |
| WO | WO 2007-005452 | 1/2007 |
| WO | WO 2011-068714 | 6/2011 |
| WO | WO 2012-112305 | 8/2012 |
| WO | WO 2012-112322 | 8/2012 |
| WO | WO 2014-131937 | 9/2014 |
| WO | WO 2014-176108 | 10/2014 |
| WO | WO 2014-206967 | 12/2014 |
| WO | WO 2015-100018 | 7/2015 |
| WO | WO 2015-100020 | 7/2015 |
| WO | WO 2015-100220 | 7/2015 |
| WO | WO 2016-028683 | 2/2016 |
| WO | WO 2016-044158 | 3/2016 |
| WO | WO 2016-064726 | 4/2016 |
| WO | WO 2016-089675 | 6/2016 |
| WO | WO 2016-205133 | 12/2016 |
| WO | WO 2016-205267 | 12/2016 |
| WO | WO 2017-007703 | 1/2017 |
| WO | WO 2017-007714 | 1/2017 |
| WO | WO 2017-083249 | 5/2017 |
| WO | WO 2017-083255 | 5/2017 |
| WO | WO 2018-080765 | 5/2018 |
| WO | WO 2018-118596 | 6/2018 |
| WO | WO 2018-118690 | 6/2018 |
| WO | WO 2018-118695 | 6/2018 |
| WO | WO 2018-134732 | 7/2018 |
| WO | WO 2018-207145 | 11/2018 |
| WO | WO 2019-215571 | 11/2019 |
| WO | WO 2020-128716 | 6/2020 |
| WO | WO 2020-128717 | 6/2020 |
| WO | WO 2020-128719 | 6/2020 |
| WO | WO 2020-128720 | 6/2020 |
| WO | WO 2020-128752 | 6/2020 |
| WO | WO 2020-128833 | 6/2020 |
| WO | WO 2020-128838 | 6/2020 |
| WO | WO2020-128844 | 6/2020 |
| WO | WO 2020-128845 | 6/2020 |
| WO | WO 2020-128852 | 6/2020 |
| WO | WO 2020-128853 | 6/2020 |
| WO | WO 2020-128854 | 6/2020 |
| WO | WO 2020-128857 | 6/2020 |
| WO | WO 2020-128858 | 6/2020 |

OTHER PUBLICATIONS

International Search Report for PCT International Application No. PCT/IB2019/060615, mailed on Feb. 26, 2020, 5 pages.
International Search Report for PCT International Application No. PCT/IB2019/060624, mailed on Mar. 11, 2020, 4 pages.
International Search Report for PCT International Application No. PCT/IB2019/060627, mailed on Jul. 2, 2020, 8 pages.
International Search Report for PCT International Application No. PCT/IB2019/060779, mailed on Mar. 10, 2020, 5 pages.
International Search Report for PCT International Application No. PCT/IB2019/060924, mailed on Apr. 29, 2020, 4 pages.
International Search Report for PCT International Application No. PCT/IB2019/060929, mailed on Mar. 23, 2020, 4 pages.
International Search Report for PCT International Application No. PCT/IB2019/060934, mailed on Mar. 18, 2020, 5 pages.
International Search Report for PCT International Application No. PCT/IB2019/060936, mailed on Mar. 30, 2020, 5 pages.

(56) References Cited

OTHER PUBLICATIONS

International Search Report for PCT International Application No. PCT/IB2019/060938, mailed on Apr. 28, 2020, 4 pages.
International Search Report for PCT International Application No. PCT/IB2019/060947, mailed on Mar. 30, 2020, 5 pages.
International Search Report for PCT International Application No. PCT/IB2019/060949, mailed on Jun. 5, 2020, 4 pages.
International Search Report for PCT International Application No. PCT/IB2019/060950, mailed on Mar. 30, 2020, 5 pages.
International Search Report for PCT International Application No. PCT/IB2019/060953, mailed on Apr. 2, 2020, 4 pages.
International Search Report for PCT International Application No. PCT/IB2019/060954, mailed on Apr. 24, 2020, 5 pages.

* cited by examiner

SHAPED ABRASIVE PARTICLE TRANSFER ASSEMBLY

CROSS REFERENCE TO RELATED APPLICATIONS

This application is a national stage filing under 35 U.S.C. 371 of PCT/IB2019/060934, filed Dec. 17, 2019, which claims the benefit of U.S. Provisional Application No. 62/781,072, filed Dec. 18, 2018, the disclosures of which are incorporated by reference in their entireties herein.

BACKGROUND

Abrasive particles and abrasive articles including the abrasive particles are useful for abrading, finishing, or grinding a wide variety of materials and surfaces in the manufacturing of goods. As such, there continues to be a need for improving the cost, performance, and ease of manufacturing abrasive articles.

SUMMARY OF THE DISCLOSURE

Various embodiments of the present disclosure relate to a shaped abrasive particle transfer assembly. The shaped abrasive particle transfer assembly includes a substrate including an adhesive and a plurality of shaped abrasive particles adhered to the substrate and forming a predetermined pattern thereon.

Various embodiments of the present disclosure further relate to a method of making a shaped abrasive particle transfer assembly. The shaped abrasive particle transfer assembly includes a substrate including an adhesive and a plurality of shaped abrasive particles adhered to the substrate and forming a predetermined pattern thereon. The method includes contacting the substrate with the plurality of shaped abrasive particles to adhere the plurality of shaped abrasive particles to the substrate.

Various embodiments of the present disclosure further relate to a coated abrasive article. The coated abrasive article includes a backing defining a major surface. The coated abrasive article further includes a shaped abrasive particle transfer assembly. The shaped abrasive particle transfer assembly includes a substrate including an adhesive and a plurality of shaped abrasive particles adhered to the substrate and forming a predetermined pattern thereon. The shaped abrasive particle transfer assembly is attached to the backing by a make coat.

Various embodiments of the present disclosure further relate to a method of making a coated abrasive article. The coated abrasive article includes a backing defining a major surface. The coated abrasive article further includes a shaped abrasive particle transfer assembly. The shaped abrasive particle transfer assembly includes a substrate including an adhesive and a plurality of shaped abrasive particles adhered to the substrate and forming a predetermined pattern thereon. The shaped abrasive particle transfer assembly is attached to the backing by a make coat. The method includes adhering the shaped abrasive particle transfer assembly to the backing. The method further includes drying the make coat.

Various embodiments of the present disclosure further relate to a method of using a coated abrasive article. The coated abrasive article includes a backing defining a major surface. The coated abrasive article further includes a shaped abrasive particle transfer assembly. The shaped abrasive particle transfer assembly includes a substrate including an adhesive and a plurality of shaped abrasive particles adhered to the substrate and forming a predetermined pattern thereon. The shaped abrasive particle transfer assembly is attached to the backing by a make coat. The method includes moving at least one of the coated abrasive article and a workpiece relative to one another while in contact with one another to remove at least a portion of the workpiece.

There are various reasons to use the shaped abrasive particle transfer assembly of the instant disclosure including the following non-limiting reasons. For example, according to various embodiments, the shaped abrasive particle transfer assembly can help to ensure that a coated abrasive article to which shaped abrasive particle transfer assembly is incorporated, can reliably replicate a desired predetermined pattern. According to further embodiments, the shaped abrasive particle transfer assembly can help to fill a void or disruption in a pattern in that the assembly can be placed in the void or disruption directly.

BRIEF DESCRIPTION OF THE FIGURES

The drawings illustrate generally, by way of example, but not by way of limitation, various embodiments discussed in the present document.

DETAILED DESCRIPTION

Figure 1A:
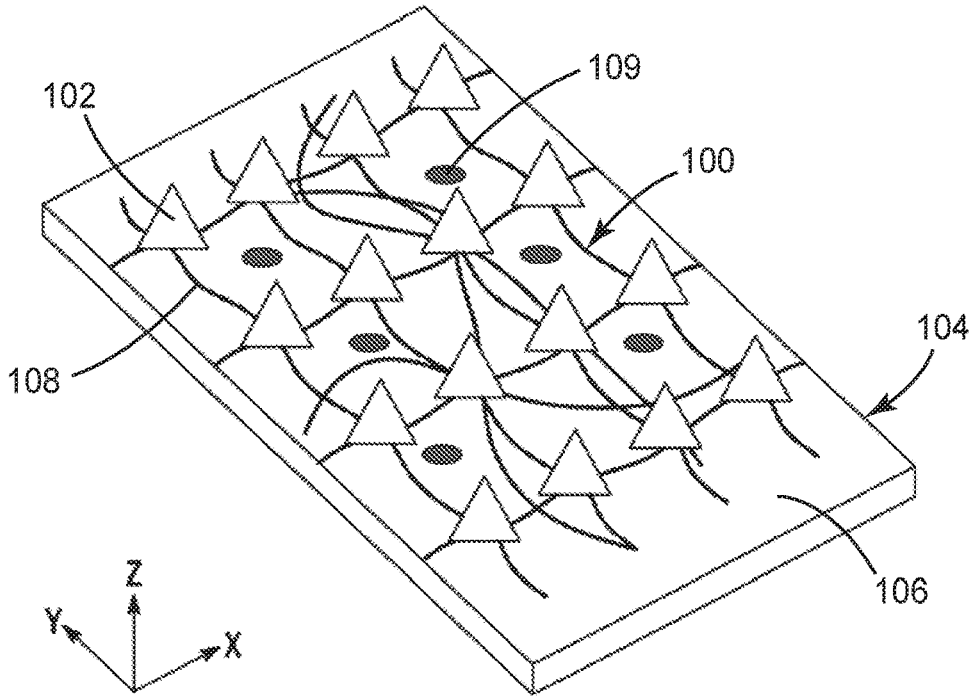
FIG. 1A is a perspective view of a shaped abrasive particle transfer assembly, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein "shaped abrasive particle" means an abrasive particle having a predetermined or non-random shape. One process to make a shaped abrasive particle such as a shaped ceramic abrasive particle includes shaping the precursor ceramic abrasive particle in a mold having a predetermined shape to make ceramic shaped abrasive particles. Ceramic shaped abrasive particles, formed in a mold, are one species in the genus of shaped ceramic abrasive particles. Other processes to make other species of shaped ceramic abrasive particles include extruding the precursor ceramic abrasive particle through an orifice having a predetermined shape, printing the precursor ceramic abrasive particle though an opening in a printing screen having a predetermined shape, or embossing the precursor ceramic abrasive particle into a predetermined shape or pattern. In other examples, the shaped ceramic abrasive particles can be cut from a sheet into individual particles. Examples of suitable cutting methods include mechanical cutting, laser cutting, or water jet cutting. Non-limiting examples of shaped ceramic abrasive particles include shaped abrasive particles, such as triangular plates, or elongated ceramic rods/filaments. Shaped ceramic abrasive particles are generally homogenous or substantially uniform and maintain their sintered shape without the use of a binder such as an organic or inorganic binder that bonds smaller abrasive particles into an agglomerated structure and excludes abrasive particles obtained by a crushing or comminution process that produces abrasive particles of random size and shape. In many embodiments, the shaped ceramic abrasive particles comprise a homogeneous structure of sintered alpha alumina or consist essentially of sintered alpha alumina.

Figure 1B:
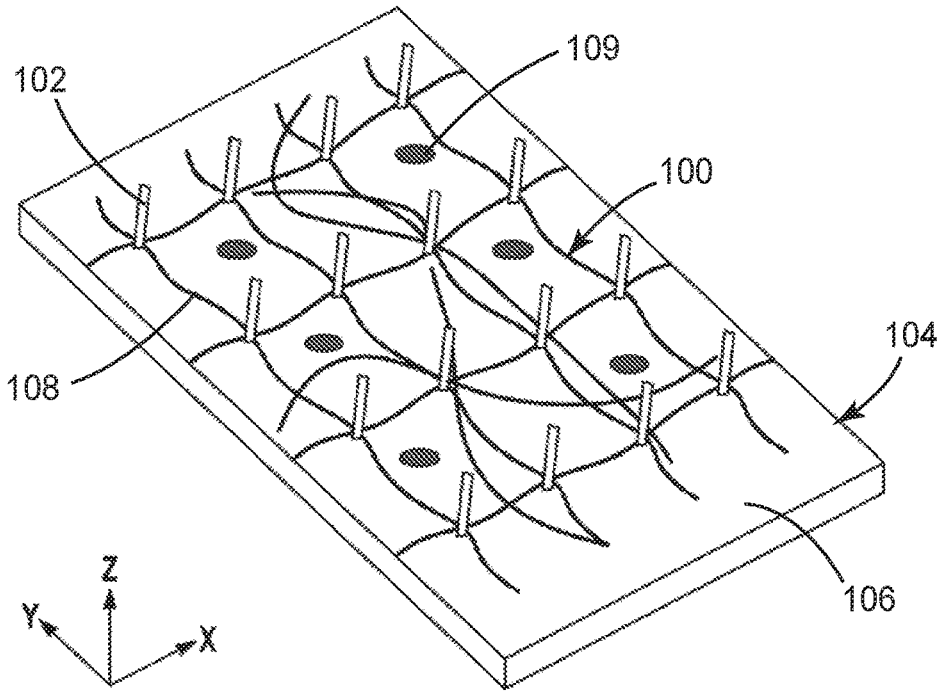
FIG. 1B is a perspective view of the shaped abrasive particle transfer assembly in which shaped abrasive particles are rotated 90 degrees about a z-axis relative to those shown in FIG. 1A, in accordance with various embodiments.

Various embodiments of the present disclosure relate to a shaped abrasive particle transfer assembly. The shaped abrasive particle transfer assembly can be used for transferring a plurality of shaped abrasive particles arranged on a substrate according to a predetermined pattern to a backing to form a coated abrasive particle. FIG. 1A is a perspective view of shaped abrasive particle transfer assembly 100. FIG. 1B is a perspective view of shaped abrasive particle transfer assembly 100 in which shaped abrasive particles 102 are rotated 90 degrees about a z-axis relative to those shown in FIG. 1A. Shaped abrasive particle transfer assembly includes a plurality of shaped abrasive particles 102 adhered to substrate 104.

The predetermined pattern of shaped abrasive particles 102 can conform to any desired predetermined pattern. For example, shaped abrasive particles 102 can be arranged as a plurality of parallel lines, in a circle, in staggered rows, or the like. As shown in FIGS. 1A and 1B, shaped abrasive particles 102 are arranged in a plurality of rows on substrate 104.

Substrate 104 can be relatively thin. For example, substrate 104 can have a thickness in a range of from about 25.4 μm to about 2550 μm, about 76.2 μm to about 762 μm, less than, equal to, or greater than about 25.4 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, 2000, 2050, 2100, 2150, 2200, 2250, 2300, 2350, 2400, 2450, 2500, or about 2550 μm. As shown, substrate 104 is substantially planar and has a constant thickness. However, in further embodiments, substrate 104 can be curved or have a substantially non-planar profile. In this case, the thickness is a measure of the larges thickness value of substrate 104.

Individual shaped abrasive particles 102 are adhered to substrate 104 by adhesive 106. Adhesive 106 can be any suitable class of adhesive. For example, adhesive 106 can be a pressure-sensitive adhesive, a resinous adhesive, a tackifier, or a mixture thereof. Examples of suitable pressure-sensitive adhesives include an acrylic pressure-sensitive adhesive, a rubber pressure-sensitive adhesive, a silicone pressure-sensitive adhesive, a styrene block copolymer pressure-sensitive adhesive, a polyvinyl ether-based adhesive, or a mixture thereof. Examples of rubber pressure-sensitive adhesives include a pressure-sensitive adhesive including a natural rubber, a synthetic rubber, or a mixture thereof. An example of a suitable acrylic pressure-sensitive adhesive includes a poly(methacrylate). Examples of suitable resinous adhesives include those having one or more resins chosen from a phenolic resin, an epoxy resin, a urea-formaldehyde resin, an aminoplast resin, a melamine resin, an acrylated epoxy resin, a urethane resin, and mixtures thereof.

According to various embodiments, substrate 104, can be an adhesive film such that opposed first and second major surfaces of substrate 104 include adhesive 106. In embodiments in which substrate 104 is an adhesive film, shaped abrasive particles 102 can be adhered to a first major surface and a second major surface can have a release liner attached thereto. The release liner can include a polyethylene, a polypropylene, a polyurethane, or a mixture thereof. As shown, substrate 104 includes a plurality of perforations 109 extending at least through adhesive 106.

As shown in FIGS. 1A and 1B, at least a portion of individual shaped abrasive particles 102 are embedded in adhesive 106. Individual shaped abrasive particles 102 can be embedded in adhesive 106 to a suitable degree that assembly 100 can be moved or transported without a substantial number of shaped abrasive particles 102 being dislodged from adhesive 106.

In some embodiments of assembly 100, reinforcing component 108 can be included. As shown in FIGS. 1A and 1B, reinforcing component has adhesive 106 disposed thereon and adhesive 106 has shaped abrasive particles 102 at least partially embedded therein. Reinforcing component 108 is a substantially porous material, which can allow a material to flow through the body of component 108. Reinforcing component can include any suitable material such as a perforated polymeric film, a perforated metal foil, a woven fabric, a knitted fabric, perforated paper, a vulcanized fiber, a nonwoven, a foam, a perforated screen, a perforated laminate, a fibrous web, or a combination thereof. In embodiments, where reinforcing component 108 is a fibrous web, the fibrous web can include a plurality of fibers forming a non-woven web and having the adhesive disposed on the individual fibers, a spun-bound non-woven web, a needle-entangled non-woven web, a braided web, a knit web, a woven web, a blown microfiber, or a combination thereof. In some embodiments, where reinforcing component 108 includes a plurality of fibers, the fibrous web can include a yarn comprising a plurality of the fibers.

Figure 2A:
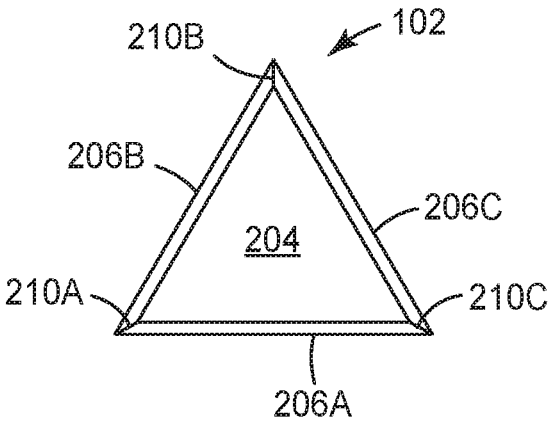
FIGS. 2A and 2B show truncated pyramidal shaped abrasive particles, in accordance with various embodiments.
Figure 2B:
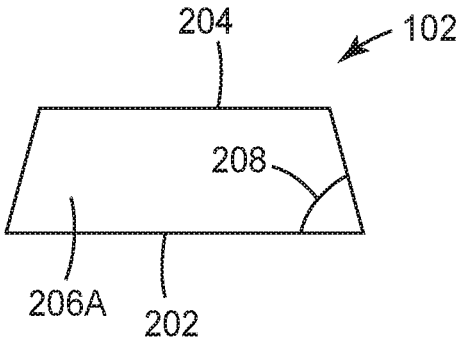

As shown in FIGS. 1A and 1B, shaped abrasive particles 102 are generally triangular shaped abrasive particles. Individual shaped abrasive particles 102 are shown in more detail in FIGS. 2A and 2B. As shown in FIGS. 2A and 2B shaped abrasive particle 102 includes a truncated regular triangular pyramid bounded by a triangular base 202, a triangular top 204, and plurality of sloping sides 206A, 206B, 206C connecting triangular base 202 (shown as equilateral although scalene, obtuse, isosceles, and right triangles are possible) and triangular top 204. Slope angle 208 is the dihedral angle formed by the intersection of side 206A with triangular base 202. In the case of shaped abrasive particle 102, all of the slope angles have equal value. In some embodiments, side edges 210A, 210B, and 210C have an average radius of curvature in a range of from about 0.5 μm to about 80 μm, about 10 μm to about 60 μm, or less than, equal to, or greater than about 0.5 μm, 5, 10, 15, 20, 25, 30, 35, 40, 45, 50, 55, 60, 65, 70, 75, or about 80 μm.

In the embodiment shown in FIGS. 2A and 2B, sides 206A, 206B, and 206C have equal dimensions and form dihedral angles with the triangular base 202 of about 82 degrees (corresponding to a slope angle of 82 degrees). However, it will be recognized that other dihedral angles (including 90 degrees) may also be used. For example, the dihedral angle between the base and each of the sides may independently range from 45 to 90 degrees (for example, from 70 to 90 degrees, or from 75 to 85 degrees). Edges connecting sides 206, base 202, and top 204 can have any suitable length. For example, a length of the edges may be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm.

Figure 3A:
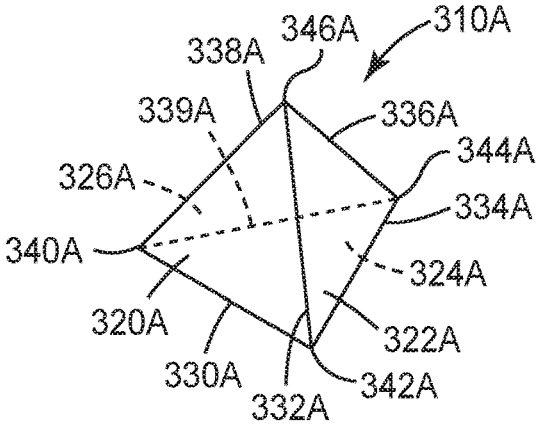
FIGS. 3A-3E show various embodiments of tetrahedral shaped abrasive particles, in accordance with various embodiments.

Although FIGS. 1A and 1B show triangular shaped abrasive particles 102 there are many other suitable examples a shaped abrasive particles that may be included in assembly 100. For example, assembly 100 can include tetrahedral shaped abrasive particles. FIGS. 3A-3E show various embodiments of tetrahedral shaped abrasive particles 310. As shown in FIGS. 3A-3E, shaped abrasive particles 310 are shaped as regular tetrahedrons. As shown in FIG. 3A, shaped abrasive particle 310A has four faces (320A, 322A, 324A, and 326A) joined by six edges (330A, 332A, 334A, 336A, 338A, and 339A) terminating at four vertices (340A, 342A, 344A, and 346A). Each of the faces contacts the other three of the faces at the edges. While a regular tetrahedron (e.g., having six equal edges and four faces) is depicted in FIG. 3A, it will be recognized that other shapes are also permissible. For example, tetrahedral abrasive particles 310 can be shaped as irregular tetrahedrons (e.g., having edges of differing lengths).

Figure 3B:
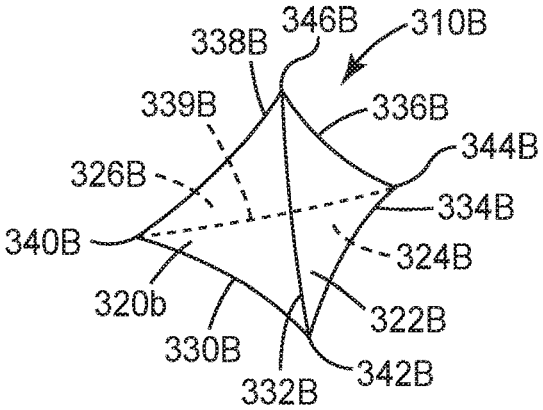

Referring now to FIG. 3B, shaped abrasive particle 310B has four faces (320B, 322B, 324B, and 326B) joined by six edges (330B, 332B, 334B, 336B, 338B, and 339B) terminating at four vertices (340B, 342B, 344B, and 346B). Each of the faces is concave and contacts the other three of the faces at respective common edges. While a particle with tetrahedral symmetry (e.g., four rotational axes of threefold symmetry and six reflective planes of symmetry) is depicted in FIG. 3B, it will be recognized that other shapes are also permissible. For example, shaped abrasive particles 310B can have one, two, or three concave faces with the remainder being planar.

Figure 3C:
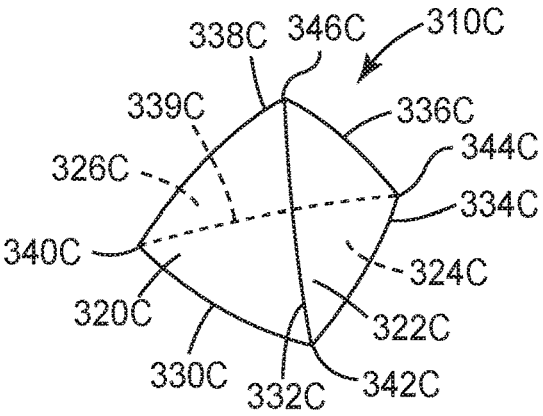

Referring now to FIG. 3C, shaped abrasive particle 310C has four faces (320C, 322C, 324C, and 326C) joined by six edges (330C, 332C, 334C, 336C, 338C, and 339C) terminating at four vertices (340C, 342C, 344C, and 346C). Each of the faces is convex and contacts the other three of the faces at respective common edges. While a particle with tetrahedral symmetry is depicted in FIG. 3C, it will be recognized that other shapes are also permissible. For example, shaped abrasive particles 310C can have one, two, or three convex faces with the remainder being planar or concave.

Figure 3D:
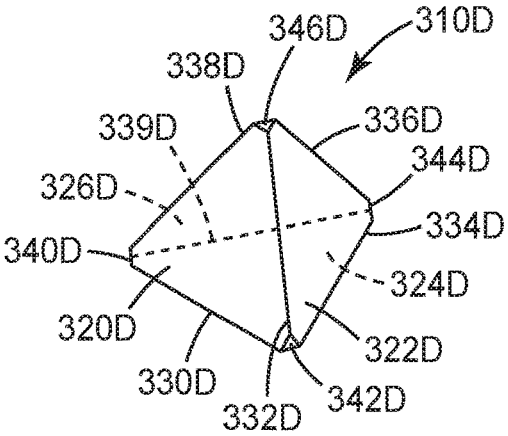

Referring now to FIG. 3D, shaped abrasive particle 310D has four faces (320D, 322D, 324D, and 326D) joined by six edges (330D, 332D, 334D, 336D, 338D, and 339D) terminating at four vertices (340D, 342D, 344D, and 346D). While a particle with tetrahedral symmetry is depicted in FIG. 3D, it will be recognized that other shapes are also permissible. For example, shaped abrasive particles 310D can have one, two, or three convex faces with the remainder being planar.

Figure 3E:
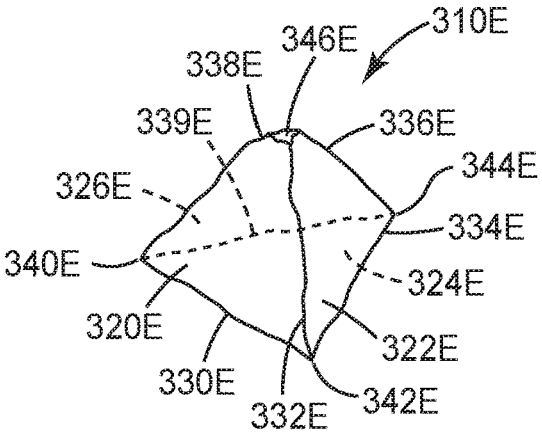

Deviations from the depictions in FIGS. 3A-3D can be present. An example of such a shaped abrasive particle 310 is depicted in FIG. 3E, showing shaped abrasive particle 310E, which has four faces (320E, 322E, 324E, and 326E) joined by six edges (330E, 332E, 334E, 336E, 338E, and 339E) terminating at four vertices (340E, 342E, 344E, and 346E). Each of the faces contacts the other three of the faces at respective common edges. Each of the faces, edges, and vertices has an irregular shape.

In any of shaped abrasive particles 310A-310E, the edges can have the same length or different lengths. The length of any of the edges can be any suitable length. As an example, the length of the edges can be in a range of from about 0.5 μm to about 2000 μm, about 150 μm to about 200 μm, or less than, equal to, or greater than about 0.5 μm, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, or about 2000 μm. Shaped abrasive particles 310A-310E can be the same size or different sizes.

Any of shaped abrasive particles 102 or 310 can include any number of shape features. The shape features can help to improve the cutting performance of any of shaped abrasive particles 102 or 310. Examples of suitable shape features include an opening, a concave surface, a convex surface, a groove, a ridge, a fractured surface, a low roundness factor, or a perimeter comprising one or more corner points having a sharp tip. Individual shaped abrasive particles can include any one or more of these features.

Shaped abrasive particles 102 or 310 or any crushed abrasive particles further described herein can include any suitable material or mixture of materials. For example, shaped abrasive particles 102 or 310 can include a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a diamond, a cubic boron nitride, a garnet, a fused alumina-zirconia, a sol-gel derived abrasive particle, a cerium oxide, a zirconium oxide, a titanium oxide, and combinations thereof. In some embodiments, shaped abrasive particles 102 or 310 and crushed abrasive particles can include the same materials. In further embodiments, shaped abrasive particles 102 or 310 and crushed abrasive particles can include different materials.

In addition to the materials already described, at least one magnetic material may be included within or coated to shaped abrasive particle 102 or 310. Examples of magnetic materials include iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite, zinc ferrite; nickel ferrite; cobalt ferrite, magnesium ferrite, barium ferrite, and strontium ferrite; yttrium iron garnet; and combinations of the foregoing. In some embodiments, the magnetizable material is an alloy containing 8 to 12 weight percent aluminum, 15 to 26 wt % nickel, 5 to 24 wt % cobalt, up to 6 wt % copper, up to 1% titanium, wherein the balance of material to add up to 100 wt % is iron. In some other embodiments, a magnetizable coating can be deposited on an abrasive particle 102 using a vapor deposition technique such as, for example, physical vapor deposition (PVD) including magnetron sputtering.

Including these magnetizable materials can allow shaped abrasive particle 102 or 310 to be responsive a magnetic field. Any of shaped abrasive particles 102 or 310 can include the same material or include different materials.

Furthermore, some shaped abrasive particles 102 or 310 can include a polymeric material and can be characterized as soft abrasive particles. The soft shaped abrasive particles described herein can independently include any suitable material or combination of materials. For example, the soft shaped abrasive particles can include a reaction product of a polymerizable mixture including one or more polymerizable resins. The one or more polymerizable resins such as a hydrocarbyl polymerizable resin. Examples of such resins include those chosen from a phenolic resin, a urea formaldehyde resin, a urethane resin, a melamine resin, an epoxy resin, a bismaleimide resin, a vinyl ether resin, an aminoplast resin (which may include pendant alpha, beta unsaturated carbonyl groups), an acrylate resin, an acrylated isocyanurate resin, an isocyanurate resin, an acrylated urethane resin, an acrylated epoxy resin, an alkyl resin, a polyester resin, a drying oil, or mixtures thereof. The polymerizable mixture can include additional components such as a plasticizer, an acid catalyst, a cross-linker, a surfactant, a mild-abrasive, a pigment, a catalyst and an antibacterial agent.

Where multiple components are present in the polymerizable mixture, those components can account for any suitable weight percentage of the mixture. For example, the polymerizable resin or resins, may be in a range of from about 35 wt % to about 99.9 wt % of the polymerizable mixture, about 40 wt % to about 95 wt %, or less than, equal to, or greater than about 35 wt %, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or about 99.9 wt %.

If present, the cross-linker may be in a range of from about 2 wt % to about 60 wt % of the polymerizable mixture, from about 5 wt % to about 10 wt %, or less than, equal to, or greater than about 2 wt %, 3, 4, 5, 6, 7, 8, 9, 10, 11, 12, 13, 14, or about 15 wt %. Examples of suitable cross-linkers include a cross-linker available under the trade designation CYMEL 303 LF, of Allnex USA Inc., Alpharetta, Georgia, USA; or a cross-linker available under the trade designation CYMEL 385, of Allnex USA Inc., Alpharetta, Georgia, USA.

If present, the mild-abrasive may be in a range of from about 5 wt % to about 65 wt % of the polymerizable mixture, about 10 wt % to about 20 wt %, or less than, equal to, or greater than about 5 wt %, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, or about 65 wt %. Examples of suitable mild-abrasives include a mild-abrasive available under the trade designation MINSTRON 353 TALC, of Imerys Talc America, Inc., Three Forks, Montana, USA; a mild-abrasive available under the trade designation USG TERRA ALBA NO. 1 CALCIUM SULFATE, of USG Corporation, Chicago, Illinois, USA; Recycled Glass (40-70 Grit) available from ESCA Industries, Ltd., Hatfield, Pennsylvania, USA, silica, calcite, nepheline, syenite, calcium carbonate, or mixtures thereof.

If present, the plasticizer may be in a range of from about 5 wt % to about 40 wt % of the polymerizable mixture, about 10 wt % to about 15 wt %, or less than, equal to, or greater than about 5 wt %, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or about 40 wt %. Examples of suitable plasticizers include acrylic resins or styrene butadiene resins. Examples of acrylic resins include an acrylic resin available under the trade designation RHOPLEX GL-618, of DOW Chemical Company, Midland, Michigan, USA; an acrylic resin available under the trade designation HYCAR 2679, of the Lubrizol Corporation, Wickliffe, Ohio, USA; an acrylic resin available under the trade designation HYCAR 26796, of the Lubrizol Corporation, Wickliffe, Ohio, USA; a polyether polyol available under the trade designation ARCOL LG-650, of DOW Chemical Company, Midland, Michigan, USA; or an acrylic resin available under the trade designation HYCAR 26315, of the Lubrizol Corporation, Wickliffe, Ohio, USA. An example of a styrene butadiene resin includes a resin available under the trade designation ROVENE 5900, of Mallard Creek Polymers, Inc., Charlotte, North Carolina, USA.

If present, the acid catalyst may be in a range of from 1 wt % to about 20 wt % of the polymerizable mixture, about 5 wt % to about 10 wt %, or less than, equal to, or greater than about 1 wt %, 2, 3, 4, 5, 6, 7, 8, 9, 10, 11, 12, 13, 14, 15, 16, 17, 18, 19, or about 20 wt %. Examples of suitable acid catalysts include a solution of aluminum chloride or a solution of ammonium chloride.

If present, the surfactant can be in a range of from about 0.001 wt % to about 15 wt % of the polymerizable mixture about 5 wt % to about 10 wt %, less than, equal to, or greater than about 0.001 wt %, 0.01, 0.5, 1, 2, 3, 4, 5, 6, 7, 8, 9, 10, 11, 12, 13, 14, or about 15 wt %. Examples of suitable surfactants include a surfactant available under the trade designation GEMTEX SC-85-P, of Innospec Performance Chemicals, Salisbury, North Carolina, USA; a surfactant available under the trade designation DYNOL 604, of Air Products and Chemicals, Inc., Allentown, Pennsylvania, USA; a surfactant available under the trade designation ACRYSOL RM-8W, of DOW Chemical Company, Midland, Michigan, USA; or a surfactant available under the trade designation XIAMETER AFE 1520, of DOW Chemical Company, Midland, Michigan, USA.

If present, the antimicrobial agent may be in a range of from 0.5 wt % to about 20 wt % of the polymerizable mixture, about 10 wt % to about 15 wt %, or less than, equal to, or greater than about 0.5 wt %, 1, 2, 3, 4, 5, 6, 7, 8, 9, 10, 11, 12, 13, 14, 15, 16, 17, 18, 19, or about 20 wt %. An example of a suitable antimicrobial agent includes zinc pyrithione.

If present, the pigment may be in a range of from about 0.1 wt % to about 10 wt % of the polymerizable mixture, about 3 wt % to about 5 wt %, less than, equal to, or greater than about 0.1 wt %, 0.2, 0.4, 0.6, 0.8, 1, 1.5, 2, 2.5, 3, 3.5, 4, 4.5, 5, 5.5, 6, 6.5, 7, 7.5, 8, 8.5, 9, 9.5, or about 10 wt %. Examples of suitable pigments include a pigment dispersion available under the trade designation SUNSPERSE BLUE 15, of Sun Chemical Corporation, Parsippany, New Jersey, USA; a pigment dispersion available under the trade designation SUNSPERSE VIOLET 23, of Sun Chemical Corporation, Parsippany, New Jersey, USA; a pigment dispersion available under the trade designation SUN BLACK, of Sun Chemical Corporation, Parsippany, New Jersey, USA; or a pigment dispersion available under the trade designation BLUE PIGMENT B2G, of Clariant Ltd., Charlotte, North Carolina, USA. The mixture of components can be polymerized by curing.

Shaped abrasive particle 102 or 310 can be formed in many suitable manners for example, the shaped abrasive particle 102 or 310 can be made according to a multi-operation process. The process can be carried out using any material or precursor dispersion material. Briefly, for embodiments where shaped abrasive particles 102 or 310 are monolithic ceramic particles, the process can include the operations of making either a seeded or non-seeded precursor dispersion that can be converted into a corresponding (e.g., a boehmite sol-gel that can be converted to alpha alumina); filling one or more mold cavities having the desired outer shape of shaped abrasive particle 102 or 310 with a precursor dispersion; drying the precursor dispersion to form precursor shaped abrasive particle; removing the precursor shaped abrasive particle 102 from the mold cavities; calcining the precursor shaped abrasive particle 102 or 310 to form calcined, precursor shaped abrasive particle 102 or 310; and then sintering the calcined, precursor shaped abrasive particle 102 or 310 to form shaped abrasive particle 102 or 310. The process will now be described in greater detail in the context of alpha-alumina-containing shaped abrasive particle 102 or 310. In other embodiments, the mold cavities may be filled with a melamine to form melamine shaped abrasive particles.

The process can include the operation of providing either a seeded or non-seeded dispersion of a precursor that can be converted into ceramic. In examples where the precursor is seeded, the precursor can be seeded with an oxide of an iron (e.g., FeO). The precursor dispersion can include a liquid that is a volatile component. In one example, the volatile component is water. The dispersion can include a sufficient amount of liquid for the viscosity of the dispersion to be sufficiently low to allow filling mold cavities and replicating the mold surfaces, but not so much liquid as to cause subsequent removal of the liquid from the mold cavity to be prohibitively expensive. In one example, the precursor dispersion includes from 2 percent to 90 percent by weight of the particles that can be converted into ceramic, such as particles of aluminum oxide monohydrate (boehmite), and at least 10 percent by weight, or from 50 percent to 70 percent, or 50 percent to 60 percent, by weight, of the volatile component such as water. Conversely, the precursor dispersion in some embodiments contains from 30 percent to 50 percent, or 40 percent to 50 percent solids by weight.

Examples of suitable precursor dispersions include zirconium oxide sols, vanadium oxide sols, cerium oxide sols, aluminum oxide sols, and combinations thereof. Suitable aluminum oxide dispersions include, for example, boehmite dispersions and other aluminum oxide hydrates dispersions. Boehmite can be prepared by known techniques or can be obtained commercially. Examples of commercially available boehmite include products having the trade designations "DISPERAL" and "DISPAL", both available from Sasol North America, Inc., or "HIQ-40" available from BASF Corporation. These aluminum oxide monohydrates are relatively pure; that is, they include relatively little, if any, hydrate phases other than monohydrates, and have a high surface area.

The physical properties of the resulting shaped abrasive particle 102 or 310 can generally depend upon the type of material used in the precursor dispersion. As used herein, a "gel" is a three-dimensional network of solids dispersed in a liquid.

The precursor dispersion can contain a modifying additive or precursor of a modifying additive. The modifying additive can function to enhance some desirable property of the abrasive particles or increase the effectiveness of the subsequent sintering step. Modifying additives or precursors of modifying additives can be in the form of soluble salts, such as water-soluble salts. They can include a metal-containing compound and can be a precursor of an oxide of magnesium, zinc, iron, silicon, cobalt, nickel, zirconium, hafnium, chromium, yttrium, praseodymium, samarium, ytterbium, neodymium, lanthanum, gadolinium, cerium, dysprosium, erbium, titanium, and mixtures thereof. The particular concentrations of these additives that can be present in the precursor dispersion can be varied.

The introduction of a modifying additive or precursor of a modifying additive can cause the precursor dispersion to gel. The precursor dispersion can also be induced to gel by application of heat over a period of time to reduce the liquid content in the dispersion through evaporation. The precursor dispersion can also contain a nucleating agent. Nucleating agents suitable for this disclosure can include fine particles of alpha alumina, alpha ferric oxide or its precursor, titanium oxides and titanates, chrome oxides, or any other material that will nucleate the transformation. The amount of nucleating agent, if used, should be sufficient to effect the transformation of alpha alumina.

A peptizing agent can be added to the precursor dispersion to produce a more stable hydrosol or colloidal precursor dispersion. Suitable peptizing agents are monoprotic acids or acid compounds such as acetic acid, hydrochloric acid, formic acid, and nitric acid. Multiprotic acids can also be used, but they can rapidly gel the precursor dispersion, making it difficult to handle or to introduce additional components. Some commercial sources of boehmite contain an acid titer (such as absorbed formic or nitric acid) that will assist in forming a stable precursor dispersion.

The precursor dispersion can be formed by any suitable means; for example, in the case of a sol-gel alumina precursor, it can be formed by simply mixing aluminum oxide monohydrate with water containing a peptizing agent or by forming an aluminum oxide monohydrate slurry to which the peptizing agent is added.

Defoamers or other suitable chemicals can be added to reduce the tendency to form bubbles or entrain air while mixing. Additional chemicals such as wetting agents, alcohols, or coupling agents can be added if desired.

A further operation can include providing a mold having at least one mold cavity, or a plurality of cavities formed in at least one major surface of the mold. In some examples, the mold is formed as a production tool, which can be, for example, a belt, a sheet, a continuous web, a coating roll such as a rotogravure roll, a sleeve mounted on a coating roll, or a die. In one example, the production tool can include polymeric material. Examples of suitable polymeric materials include thermoplastics such as polyesters, polycarbonates, poly(ether sulfone), poly(methyl methacrylate), polyurethanes, polyvinylchloride, polyolefin, polystyrene, polypropylene, polyethylene or combinations thereof, or thermosetting materials. In one example, the entire tool is made from a polymeric or thermoplastic material. In another example, the surfaces of the tool in contact with the precursor dispersion while the precursor dispersion is drying, such as the surfaces of the plurality of cavities, include polymeric or thermoplastic materials, and other portions of the tool can be made from other materials. A suitable polymeric coating can be applied to a metal tool to change its surface tension properties, by way of example.

A polymeric or thermoplastic production tool can be replicated off a metal master tool. The master tool can have the inverse pattern of that desired for the production tool. The master tool can be made in the same manner as the production tool. In one example, the master tool is made out of metal (e.g., nickel) and is diamond-turned. In one example, the master tool is at least partially formed using stereolithography. The polymeric sheet material can be heated along with the master tool such that the polymeric material is embossed with the master tool pattern by pressing the two together. A polymeric or thermoplastic material can also be extruded or cast onto the master tool and then pressed. The thermoplastic material is cooled to solidify and produce the production tool. If a thermoplastic production tool is utilized, then care should be taken not to generate excessive heat that can distort the thermoplastic production tool, limiting its life.

Access to cavities can be from an opening in the top surface or bottom surface of the mold. In some examples, the cavities can extend for the entire thickness of the mold. Alternatively, the cavities can extend only for a portion of the thickness of the mold. In one example, the top surface is substantially parallel to the bottom surface of the mold with the cavities having a substantially uniform depth. At least one side of the mold, the side in which the cavities are formed, can remain exposed to the surrounding atmosphere during the step in which the volatile component is removed.

The cavities have a specified three-dimensional shape to make shaped abrasive particle 102. The depth dimension is equal to the perpendicular distance from the top surface to the lowermost point on the bottom surface. The depth of a given cavity can be uniform or can vary along its length and/or width. The cavities of a given mold can be of the same shape or of different shapes.

A further operation involves filling the cavities in the mold with the precursor dispersion (e.g., by a conventional technique). In some examples, a knife roll coater or vacuum slot die coater can be used. A mold release agent can be used to aid in removing the particles from the mold if desired. Examples of mold release agents include oils such as peanut oil or mineral oil, fish oil, silicones, polytetrafluoroethylene, zinc stearate, and graphite. In general, a mold release agent such as peanut oil, in a liquid, such as water or alcohol, is applied to the surfaces of the production tool in contact with the precursor dispersion such that from about 0.1 mg/in$^2$ (0.6 mg/cm$^2$) to about 3.0 mg/in$^2$ (20 mg/cm$^2$), or from about 0.1 mg/in$^2$ (0.6 mg/cm$^2$) to about 5.0 mg/in$^2$ (30 mg/cm$^2$), of the mold release agent is present per unit area of the mold when a mold release is desired. In some embodiments, the top surface of the mold is coated with the precursor dispersion. The precursor dispersion can be pumped onto the top surface.

In a further operation, a scraper or leveler bar can be used to force the precursor dispersion fully into the cavity of the mold. The remaining portion of the precursor dispersion that does not enter the cavity can be removed from the top surface of the mold and recycled. In some examples, a small portion of the precursor dispersion can remain on the top surface, and in other examples the top surface is substantially free of the dispersion. The pressure applied by the scraper or leveler bar can be less than 100 psi (0.6 MPa), or less than 50 psi (0.3 MPa), or even less than 10 psi (60 kPa). In some examples, no exposed surface of the precursor dispersion extends substantially beyond the top surface.

In those examples where it is desired to have the exposed surfaces of the cavities result in planar faces of the shaped abrasive particles, it can be desirable to overfill the cavities (e.g., using a micronozzle array) and slowly dry the precursor dispersion.

A further operation involves removing the volatile component to dry the dispersion. The volatile component can be removed by fast evaporation rates. In some examples, removal of the volatile component by evaporation occurs at temperatures above the boiling point of the volatile component. An upper limit to the drying temperature often depends on the material the mold is made from. For polypropylene tool, the temperature should be less than the melting point of the plastic. In one example, for a water dispersion of from about 40 to 50 percent solids and a polypropylene mold, the drying temperatures can be from about 90° C. to about 165° C., or from about 105° C. to about 150° C., or from about 105° C. to about 120° C. Higher temperatures can lead to improved production speeds but can also lead to degradation of the polypropylene tool, limiting its useful life as a mold.

During drying, the precursor dispersion shrinks, often causing retraction from the cavity walls. For example, if the cavities have planar walls, then the resulting shaped abrasive particle 102 can tend to have at least three concave major sides. It is presently discovered that by making the cavity walls concave (whereby the cavity volume is increased) it is possible to obtain shaped abrasive particle 102 that have at least three substantially planar major sides. The degree of concavity generally depends on the solids content of the precursor dispersion.

A further operation involves removing resultant precursor shaped abrasive particle 102 from the mold cavities. The precursor shaped abrasive particle 102 or 310 can be removed from the cavities by using the following processes alone or in combination on the mold: gravity, vibration, ultrasonic vibration, vacuum, or pressurized air to remove the particles from the mold cavities.

The precursor shaped abrasive particle 102 or 310 can be further dried outside of the mold. If the precursor dispersion is dried to the desired level in the mold, this additional drying step is not necessary. However, in some instances it can be economical to employ this additional drying step to minimize the time that the precursor dispersion resides in the mold. The precursor shaped abrasive particle 102 or 310 will be dried from 10 to 480 minutes, or from 120 to 400 minutes, at a temperature from 50° C. to 160° C., or 120° C. to 150° C.

A further operation involves calcining the precursor shaped abrasive particle 102 or 310. During calcining, essentially all the volatile material is removed, and the various components that were present in the precursor dispersion are transformed into metal oxides. The precursor shaped abrasive particle 102 or 310 is generally heated to a temperature from 400° C. to 800° C. and maintained within this temperature range until the free water and over 90 percent by weight of any bound volatile material are removed. In an optional step, it can be desirable to introduce the modifying additive by an impregnation process. A water-soluble salt can be introduced by impregnation into the pores of the calcined, precursor shaped abrasive particle 102. Then the precursor shaped abrasive particle 102 are pre-fired again.

A further operation can involve sintering the calcined, precursor shaped abrasive particle 102 or 310 to form particles 102 or 310. In some examples where the precursor includes rare earth metals, however, sintering may not be necessary. Prior to sintering, the calcined, precursor shaped abrasive particle 102 or 310 are not completely densified and thus lack the desired hardness to be used as shaped abrasive particle 102 or 310. Sintering takes place by heating the calcined, precursor shaped abrasive particle 102 or 310 to a temperature of from 1000° C. to 1650° C. The length of time for which the calcined, precursor shaped abrasive particle 102 or 310 can be exposed to the sintering temperature to achieve this level of conversion depends upon various factors, but from five seconds to 48 hours is possible.

In another embodiment, the duration of the sintering step ranges from one minute to 90 minutes. After sintering, the shaped abrasive particle 102 or 310 can have a Vickers hardness of 10 GPa (gigaPascals), 16 GPa, 18 GPa, 20 GPa, or greater.

Additional operations can be used to modify the described process, such as, for example, rapidly heating the material from the calcining temperature to the sintering temperature, and centrifuging the precursor dispersion to remove sludge and/or waste. Moreover, the process can be modified by combining two or more of the process steps if desired.

As shown in FIGS. 1A and 1B each of the plurality of shaped abrasive particles 102 can have a specified z-direction rotational orientation about a z-axis passing through individual shaped abrasive particles 102 and through reinforcing component 108 and adhesive 106 at a 90 degree angle to component 108. Shaped abrasive particles 102 are orientated with a surface feature, such as a substantially planar surface of particle 102, rotated into a specified angular position about the z-axis. The specified z-direction rotational orientation occurs more frequently than would occur by a random z-directional rotational orientation of the surface feature due to electrostatic coating or drop coating of shaped abrasive particles 102 or 310 when forming shaped abrasive particle transfer assembly 100. As such, by controlling the z-direction rotational orientation of a significantly large number of shaped abrasive particles 102, the cut rate, finish, or both of a resulting coated abrasive article to which shaped abrasive particle transfer assembly 100 is applied can be varied from those manufactured using an electrostatic coating method. In various embodiments, at least 50, 51, 55, 60, 65, 70, 75, 80, 85, 90, 95, or 99 percent of shaped abrasive particles 102 can have a specified z-direction rotational orientation which does not occur randomly and which can be substantially the same for all of the aligned particles. In other embodiments, about 50 percent of shaped abrasive particles 102 can be aligned in a first direction and about 50 percent of shaped abrasive particles 102 can be aligned in a second direction. In one embodiment, the first direction is substantially orthogonal to the second direction. Although precise z-direction rotational orientations for shaped abrasive particles 102 are dicussed, some embodiments of assembly 100 may include randomly oriented shaped abrasive particles.

Figure 4:
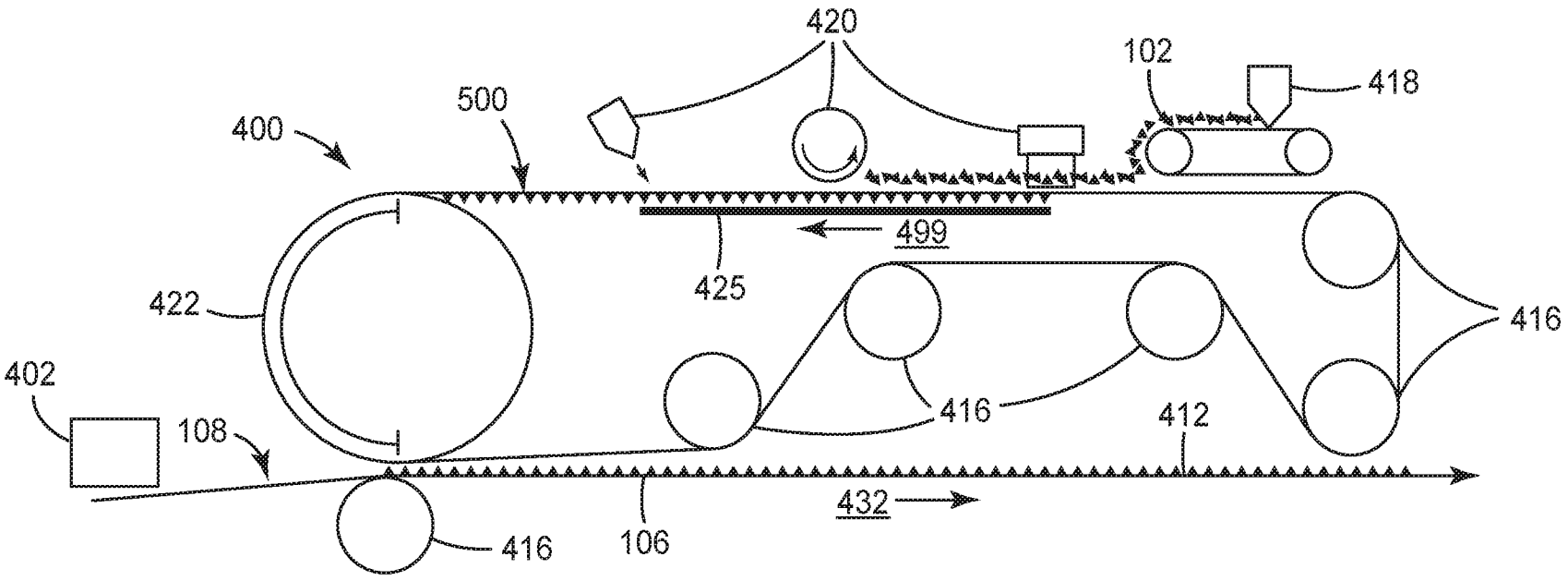
FIG. 4 is a schematic figure showing an abrasive article maker, in accordance with various embodiments.
Figure 5:
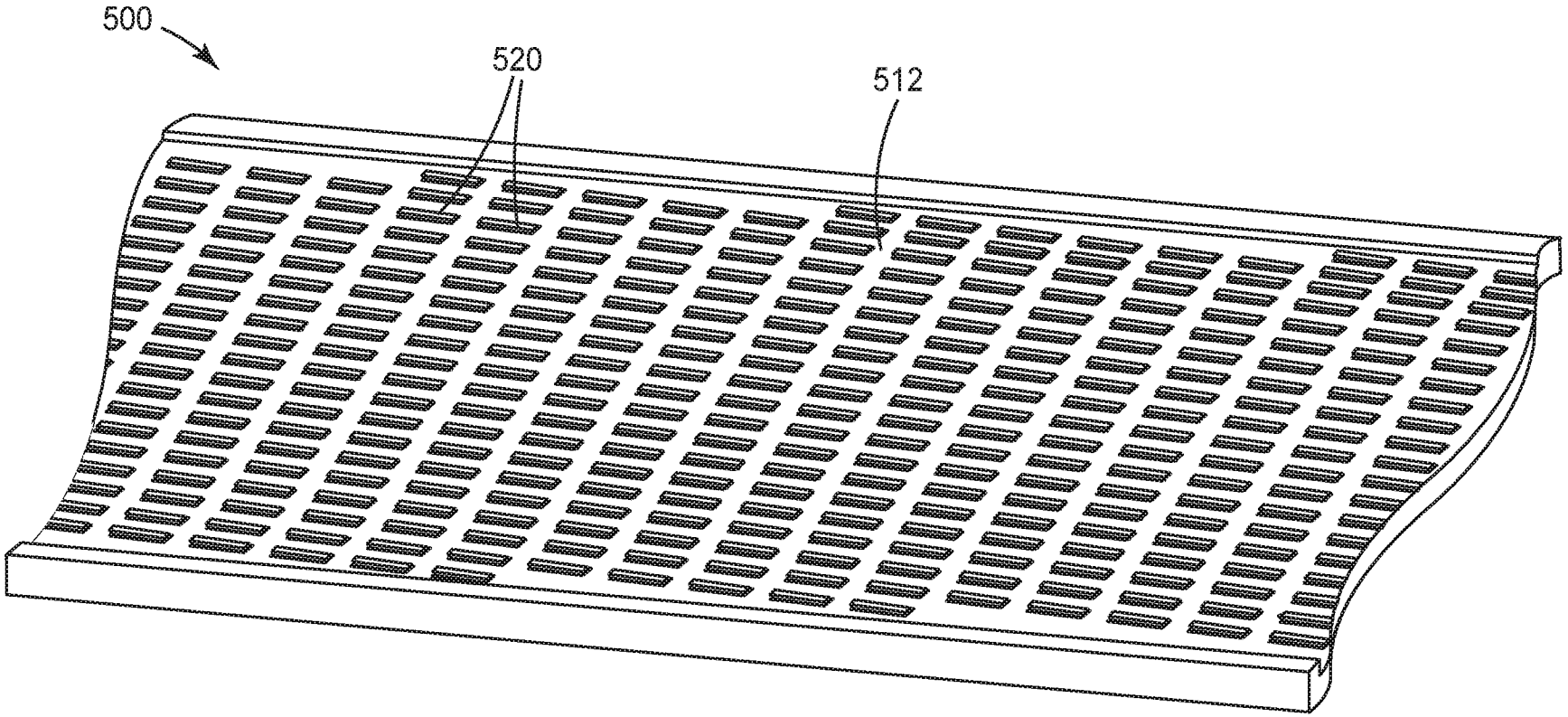
FIG. 5 is a perspective view of a production tool of the abrasive article maker, in accordance with various embodiments.

The specific z-direction rotational orientation of abrasive particles 102 as well as the overall predetermined pattern of shaped abrasive particles 102 on assembly 100 can be achieved through use of an article maker. FIG. 4 is a schematic figure showing article maker 400 and FIG. 5 is a perspective view of production tool of article maker 400. Referring now to FIG. 4, and FIG. 5, abrasive article maker 400 according to the present disclosure includes shaped abrasive particles 102 (although in alternative embodiments, shaped abrasive particles 310 can be used) removably disposed within cavities 520 of production tool 500 having first web path 499 guiding production tool 500 through abrasive article maker 400 such that it wraps a portion of an outer circumference of shaped abrasive particle transfer roll 422. Apparatus 400 can include, for example, idler roller 416 and adhesive delivery system 402. These components unwind reinforcing component 108, deliver adhesive 106 via adhesive delivery system 402 to an adhesive coat applicator and apply adhesive to first major surface 412 of reinforcing component 108. Thereafter adhesive coated reinforcing component 108 is positioned by idler roll 416 for application of shaped abrasive particles 102 to first major surface 412 coated with adhesive 106. Second web path 432 for adhesive coated reinforcing component 108 passes through abrasive article maker apparatus 400 such that adhesive 106 positioned facing dispensing surface 512 of production tool 500 that is positioned between adhesive coated reinforcing component 108 and the outer circumference of the shaped abrasive particle transfer roll 422. Adhesive delivery system 402 can be a simple pan or reservoir containing adhesive 106 or a pumping system with a storage tank and delivery plumbing to translate adhesive 106 to the needed location. An adhesive applicator can be, for example, a coater, a roll coater, a spray system, a die coater, or a rod coater. Alternatively, a pre-coated coated reinforcing component 108 can be positioned by idler roll 416 for application of shaped abrasive particles 102 to the first major surface.

As shown in FIG. 5, production tool 500 comprises a plurality of cavities 520 having a complimentary shape to shaped abrasive particle 102 to be contained therein. Shaped abrasive particle feeder 418 supplies at least some shaped abrasive particles 102 to production tool 500. Shaped abrasive particle feeder 418 can supply an excess of shaped abrasive particles 102 such that there are more shaped abrasive particles 102 present per unit length of production tool in the machine direction than cavities 520 present. Supplying an excess of shaped abrasive particles 102 helps to ensure that a desired number of cavities 520 within production tool 500 are eventually filled with shaped abrasive particle 102. Since the bearing area and spacing of shaped abrasive particles 102 is often designed into production tool 500 for the specific grinding application it is desirable to not have too many unfilled cavities 520. Shaped abrasive particle feeder 418 can be the same width as the production tool 500 and can supply shaped abrasive particles 102 across the entire width of production tool 500. Shaped abrasive particle feeder 418 can be, for example, a vibratory feeder, a hopper, a chute, a silo, a drop coater, or a screw feeder.

Optionally, filling assist member 420 can be provided after shaped abrasive particle feeder 418 to move shaped abrasive particles 102 around on the surface of production tool 500 and to help orientate or slide shaped abrasive particles 102 into the cavities 520. Filling assist member 420 can be, for example, a doctor blade, a felt wiper, a brush having a plurality of bristles, a vibration system, a blower or air knife, a vacuum box, or combinations thereof. Filling assist member 420 moves, translates, sucks, or agitates shaped abrasive particles 102 on dispensing surface 512 (top or upper surface of production tool 500 in FIG. 4) to place more shaped abrasive particles 102 into cavities 520. Without filling assist member 420, generally at least some of shaped abrasive particles 102 dropped onto dispensing surface 512 will fall directly into cavity 520 and no further movement is required but others may need some additional movement to be directed into cavity 520. Optionally, filling assist member 420 can be oscillated laterally in the cross machine direction or otherwise have a relative motion such as circular or oval to the surface of production tool 500 using a suitable drive to assist in completely filling each cavity 520 in production tool 500 with a shaped abrasive particle 102. If a brush is used as the filling assist member 420, the bristles may cover a section of dispensing surface 512 from 2-60 inches (5.0-153 cm) in length in the machine direction across all or most all of the width of dispensing surface 512, and lightly rest on or just above dispensing surface 512, and be of a moderate flexibility. Vacuum box, if used as filling assist member 420, can be used in conjunction with production tool 500 having cavities 520 extending completely through production tool 500. Vacuum box is located near shaped abrasive particle feeder 418 and may be located before or after shaped abrasive particle feeder 418, or encompass any portion of a web span between a pair of idler rolls 416 in the shaped abrasive particle filling and excess removal section of the apparatus. Alternatively, production tool 500 can be supported or pushed on by a shoe or a plate to assist in keeping it planar in this section of the apparatus instead or in addition to vacuum box 425. It is possible to include one or more assist members 420 to remove excess shaped abrasive particles 102, in some embodiments it may be possible to include only one assist member 420.

After leaving the shaped abrasive particle filling and excess removal section of apparatus 400 shaped abrasive particles 102 in production tool 500 travel towards adhesive coated reinforcing component 108. Shaped abrasive particle transfer roll 422 is provided and production tool 500 can wrap at least a portion of the roll's circumference. In some embodiments, production tool 500 wraps between 30 to 180 degrees, or between 90 to 180 degrees of the outer circumference of shaped abrasive particle transfer roll 422. In some embodiments, the speed of the dispensing surface 512 and the speed of adhesive coated reinforcing component 108 are speed matched to each other within ±10 percent, ±5 percent, or ±1 percent, for example.

Various methods can be employed to transfer shaped abrasive particles 102 from cavities 520 of production tool 500 to adhesive coated reinforcing component 108. One method includes a pressure assist method where each cavity 520 in production tool 500 has two open ends or the back surface or the entire production tool 500 is suitably porous and shaped abrasive particle transfer roll 422 has a plurality of apertures and an internal pressurized source of air. With pressure assist, production tool 500 does not need to be inverted but it still may be inverted. Shaped abrasive particle transfer roll 422 can also have movable internal dividers such that the pressurized air can be supplied to a specific arc segment or circumference of the roll to blow shaped abrasive particles 102 out of the cavities and onto adhesive coated reinforcing component 108 at a specific location. In some embodiments, shaped abrasive particle transfer roll 422 may also be provided with an internal source of vacuum without a corresponding pressurized region or in combination with the pressurized region typically prior to the pressurized region as shaped abrasive particle transfer roll 422 rotates. The vacuum source or region can have movable dividers to direct it to a specific region or arc segment of shaped abrasive particle transfer roll 422. The vacuum can suck shaped abrasive particles 102 firmly into cavities 520 as the production tool 500 wraps shaped abrasive particle transfer roll 422 before subjecting shaped abrasive particles 102 to the pressurized region of shaped abrasive particle transfer roll 422. This vacuum region be used, for example, with shaped abrasive particle removal member to remove excess shaped abrasive particles 102 from dispensing surface 512 or may be used to simply ensure shaped abrasive particles 102 do not leave cavities 520 before reaching a specific position along the outer circumference of the shaped abrasive particle transfer roll 422.

The gap between production tool 500 and adhesive coated reinforcing component 108 can be very small. This can particularly be the case when shaped abrasive particles 102 have a largest dimension (e.g., largest diameter, length, or width) that is less than about 22.8 mm. It can be important to control the size of the gap between production tool 500 and adhesive coated reinforcing component 108 to increase the probability that the pattern of shaped abrasive particles 102 in production tool 500 is reliably replicated on adhesive coated reinforcing component 108. If the gap is too large, shaped abrasive particles 102 have more opportunity to rotate or otherwise deviate from their intended path towards adhesive coated reinforcing component 108. According to various embodiments, the gap between production tool 500 and adhesive coated reinforcing component 108 can be in a range of from about 0.0001 μm to about 1270 μm, about 0.01 μm to about 254 μm, less than, equal to, or greater than about 0.0001 μm, 0.001, 0.01, 0.05, 0.1, 0.5, 1, 5, 10, 15, 20, 25, 50, 75, 100, 125, 150, 175, 200, 225, 250, 275, 300, 325, 350, 375, 400, 425, 450, 475, 500, 525, 550, 575, 600, 625, 650, 675, 700, 725, 750, 775, 800, 825, 850, 875, 900, 925, 950, 975, 1000, 1125, 1130, 1135, 1140, 1145, 1150, 1155, 1160, 1170, 1175, 1180, 1185, 1190, 1195, 1200, 1205, 1210, 1215, 1220, 1225, 1230, 1235, 1240, 1245, 1250, 1255, 1260, 1265, 1270, or about 1275 μm. The exact dimensions of the gap can be tuned for the specific shaped abrasive particles 102 that are used. According to some embodiments, the intended pattern of shaped abrasive particles 102 can be more reliably replicated on adhesive coated reinforcing component 108, ultimately forming shaped abrasive particle transfer assembly 100, than by directly depositing shaped abrasive particles 102 on a backing having a make coat precursor coated thereon. This can be because adhesive coated reinforcing component 108 can be much thinner than a backing having a make coat precursor coated thereon. This can make it easier to handle adhesive coated reinforcing component 108 and to bring it close to production tool 500, without contact therebetween. The surface of adhesive coated reinforcing component 108 can also be more regular or planar than a backing having a make coat precursor coated thereon as the make coat precursor may be substantially non-planar or include irregularities that can result in contact between the make coat precursor and production tool. This can require mitigation strategies such as increasing the gap between production tool 500 and the make coat precursor, which in turn can increase the probability that the pattern of shaped abrasive particles 102 on the make coat precursor may not be fully replicated.

In some embodiments, there may be no gap between production tool 500 and adhesive coated reinforcing component 108 and the two can be brought into contact with each other. In an embodiment such as this, adhesive 106 of assembly 100 can be an adhesive that is capable of contacting production tool 500 without transferring a substantial amount of adhesive 106 from adhesive coated reinforcing component 108 to production tool 500. For example, in some embodiments no adhesive is transferred from adhesive coated reinforcing component 108 to production tool 500. In further embodiments, if any adhesive is transferred between adhesive coated reinforcing component 108 and production tool 500 the amount of the total adhesive of component 108 can be in a range of from about 0.01 wt % to about 10 wt % of adhesive 106, about 0.1 wt % to about 5 wt %, less then, equal to, or greater than about 0.01, 0.05, 0.1, 0.15, 0.25, 0.5, 1, 1.25, 1.50, 1.75, 2, 2.25, 2.50, 2.75, 3, 3.25, 3.50, 3.75, 4, 4.25, 4.50, 4.75, 5, 5.25, 5.50, 5.75, 6, 6.25, 6.50, 6.75, 7, 7.25, 7.50, 7.75, 8, 8.25, 8.50, 8.75, 9, 9.25, 9.5, 9.75, or about 10 wt %.

Shaped abrasive particle transfer assembly 100 is formed after shaped abrasive particles 102 are deposited on adhesive coated reinforcing component 108. Shaped abrasive particle transfer assembly 100 can be perforated. Perforation can occur by puncturing holes in assembly 100. Perforation can also occur by stretching assembly 100 in a web or cross-web direction. Perforation can occur before shaped abrasive particles 102 are deposited on reinforcing component 108. Perforation can even occur before reinforcing component 108 is put into make 400. Although in some embodiments, it may be possible to perforate reinforcing component 108 after shaped abrasive particles 102 are deposited thereon.

After separating from shaped abrasive particle transfer roll 422, production tool 500 travels along first web path 499 back towards the shaped abrasive particle filling and excess removal section of the apparatus with the assistance of idler rolls 416 as necessary. An optional production tool cleaner can be provided to remove stuck shaped abrasive particles 102 still residing in cavities 520 as well as to remove adhesive 106 transferred to dispensing surface 512. Choice of the production tool cleaner can depend on the configuration of the production tool and could be either alone or in combination, an additional air blast, solvent or water spray, solvent or water bath, an ultrasonic horn, or an idler roll the production tool wraps to use push assist to force shaped abrasive particles 102 out of the cavities 520. Thereafter endless production tool 500 or belt advances to a shaped abrasive particle filling and excess removal section to be filled with new shaped abrasive particles 102.

Although maker 400 is shown as including production tool 500 as a belt, it is possible in some alternative embodiments for maker 400 to include production tool 500 on abrasive particle transfer roll 422. For example, abrasive particle transfer roll 422 may include a plurality of cavities 520 to which shaped abrasive particles 102 are directly fed. Shaped abrasive particles 102 can be selectively held in place with a vacuum, which can be disengaged to release shaped abrasive particles 102 on coated reinforcement component 108. Maker 400 can also include components such as one or more magnets that can be used to rotate or position shaped abrasive particles 102 that are responsive to a magnetic field.

Various idler rolls 416 can be used to guide the shaped abrasive particle transfer assembly 100 having a predetermined, reproducible, non-random pattern of shaped abrasive particles 102 on the first major surface that were applied by shaped abrasive particle transfer roll 422 and held onto the first major surface by the make coat resin along second web path 432 towards a backing component (shown as backing 602 in FIG. 6) having a make resin coated thereon. The backing can include at least one material chosen from a polymeric film, a metal foil, a woven fabric, a knitted fabric, paper, vulcanized fiber, a staple fiber, a continuous fiber, a nonwoven, a foam, a screen, and a laminate. The make coat can include a resinous adhesive. The resinous adhesive can include one or more resins chosen from a phenolic resin, an epoxy resin, a urea-formaldehyde resin, an acrylate resin, an aminoplast resin, a melamine resin, an acrylated epoxy resin, a urethane resin, and mixtures thereof. In some embodiments, adhesive 106 can be the same material or mixture of materials as the make coat.

The second major surface of shaped abrasive particle transfer assembly 100 is laminated to the backing by being brought into direct contact with the make coat of the backing. If second major surface has a release liner attached thereto, it can be removed prior to contact. Upon contact between shaped abrasive particle transfer assembly 100 and the make coat, the resinous adhesive material of make coat at least partially immerses shaped abrasive particle transfer assembly 100 such that assembly is ultimately integral to the make coat. Shaped abrasive particle transfer assembly 100 can be immersed in the make coat to such a degree that that a portion of the make coat is distributed over a portion of the first major surface, second major surface, or both of shaped abrasive particle transfer assembly 100. The make coat can alternatively be manually distributed about shaped abrasive particle transfer assembly 100. Alternatively, the make coat can flow between and through first and second major surfaces of shaped abrasive particle transfer assembly 100 through spaces in reinforcing component 108, perforations 109 in adhesive 106, or both. The make coat can be driven through assembly 100 by way of a capillary or wicking action. Attaching assembly 100 and the make coat resin forms coated abrasive article precursor.

Coated abrasive article precursor can be driven by idle rollers 416 into an oven for curing the make coat resin. Alternatively, coated abrasive article precursor can be hand delivered into the oven. Prior to entering the oven, an optional second shaped abrasive particle coater can be provided to place additional abrasive particles, such as crushed abrasive particles or fillers, onto the make coat. In the oven, the make coat can be heated to a temperature in a range of from about 20° C. to about 220° C., about 100° C. to about 150° C., less than, equal to, or greater than about 20° C., 30, 40, 50, 60, 70, 80, 90, 100, 110, 120, 130, 140, 150, 160, 170, 180, 190, 200, 210, or about 220° C. In some embodiments, reinforcing component 108 can be thermally degraded by this heating step.

The crushed abrasive particles can, for example, have an average diameter ranging from about 10 μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the crushed abrasive particles can have an abrasives industry-specified nominal grade. Such abrasives industry-accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (e.g., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation. Where present as a blend, shaped abrasive particles 102 and crushed abrasive particles can independently be in a range of from about 5 wt % to about 96 wt % of the blend, about 15 wt % to about 50 wt %, less than, equal to, or greater than about 5 wt %, 10, 15, 20, 25, 30, 35, 40, 45, 50, 55, 60, 65, 70, 75, 80, 85, 90, 95, or about 96 wt %.

Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, a hydrated aluminum compound, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides. In some embodiments, individual shaped abrasive particles 102 or individual crushed abrasive particles can be at least partially coated with an amorphous, ceramic, or organic coating. Examples of suitable components of the coatings include, a silane, glass, iron oxide, aluminum oxide, or combinations thereof. Coatings such as these can aid in processability and bonding of the particles to a resin of a binder.

The second abrasive particle coater can be a drop coater, spray coater, or an electrostatic coater as known to those of skill in the art. Following curing the coated abrasive article precursor can enter into an optional festoon along second web path 432 prior to further processing such as the addition of a size coat, curing of the size coat, and other processing steps known to those of skill in the art of making coated abrasive articles.

Figure 6:
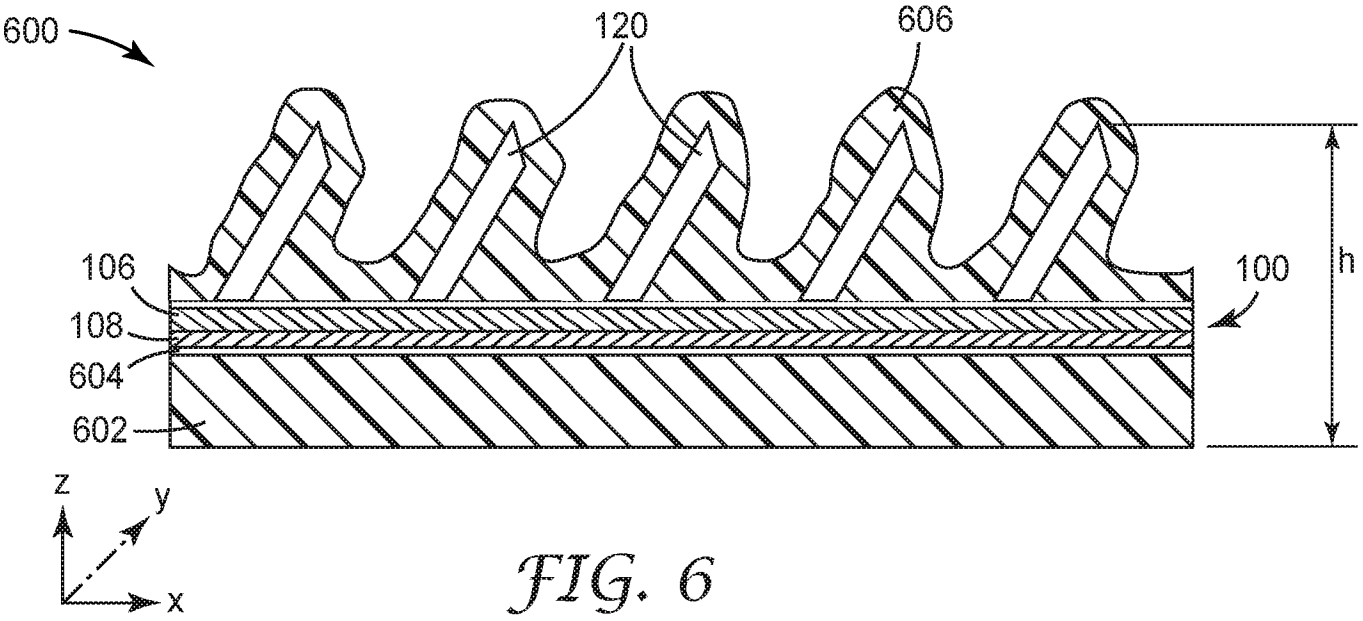
FIG. 6 is a sectional view of a coated abrasive article, in accordance with various embodiments.

FIG. 6 is a sectional view of coated abrasive article 600, which is produced according the herein described methods. Coated abrasive article 600 includes backing 602 defining a surface along an x-y direction. Backing 602 has make coat 604, applied over a first surface of backing 602. Attached or partially embedded in make coat 604 are a plurality of shaped abrasive particles 102 and shaped abrasive particle transfer assembly 100. Although shaped abrasive particles 102 are shown any other shaped abrasive particle described herein can be included in coated abrasive article 600. An optional second layer of binder, hereinafter referred to as size coat 606, is dispersed over shaped abrasive particles 102.

Make coat 604 secures shaped abrasive particles 102 to, assembly 100, or both to backing 602, and size coat 606 can help to reinforce shaped abrasive particles 102. Make coat 604 size coat 606, or both can include the same resinous adhesive.

As shown, coated abrasive article 600 is a belt, or a portion thereof, adapted for linear movement. However, in further embodiments, coated abrasive article 600 can be a wheel, or a portion thereof, that is adapted for rotational movement. Examples of suitable wheels include a depressed-center grinding wheel or a cut-off wheel.

According to various embodiments, a method of using coated abrasive article 600 includes contacting shaped abrasive particles 102 with a workpiece or substrate. The workpiece or substrate can include many different materials such as steel, steel alloy, aluminum, plastic, wood, or a combination thereof. Upon contact, one of abrasive article 600 and the workpiece is moved relative to one another and a portion of the workpiece is removed.

Additional Embodiments

The following exemplary embodiments are provided, the numbering of which is not to be construed as designating levels of importance:

Embodiment 1 provides a shaped abrasive particle transfer assembly, the assembly comprising:

a substrate comprising an adhesive; and a plurality of shaped abrasive particles adhered to the substrate and forming a predetermined pattern thereon.

Embodiment 2 provides the shaped abrasive particle transfer assembly of Embodiment 1, wherein the substrate has a thickness in a range of from about 25.4 μm to about 2540 μm.

Embodiment 3 provides the shaped abrasive particle transfer assembly of any one of Embodiments 1 or 2, wherein the substrate has a thickness in a range of from about 76.2 μm to about 762 μm.

Embodiment 4 provides the shaped abrasive particle transfer assembly of any one of Embodiments 1-3, wherein the substrate comprises a substantially planar profile.

Embodiment 5 provides the shaped abrasive particle transfer assembly of any one of Embodiments 1-4, wherein the adhesive comprises a pressure-sensitive adhesive, a resinous adhesive, a tackifier, or a mixture thereof.

Embodiment 6 provides the shaped abrasive particle transfer assembly of Embodiment 5, wherein the pressure-sensitive adhesive comprises an acrylic pressure-sensitive adhesive, a rubber pressure-sensitive adhesive, a silicone pressure-sensitive adhesive, a styrene block copolymer pressure-sensitive adhesive, a polyvinyl ether-based adhesive, or a mixture thereof.

Embodiment 7 provides the shaped abrasive particle transfer assembly of Embodiment 6, wherein the acrylic pressure-sensitive adhesive comprises a poly(methacrylate).

Embodiment 8 provides the shaped abrasive particle transfer assembly of Embodiment 6, wherein the rubber pressure-sensitive adhesive comprises a natural rubber, a synthetic rubber, or a mixture thereof.

Embodiment 9 provides the shaped abrasive particle transfer assembly of any one of Embodiments 5-7, wherein resinous adhesive comprises one or more resins chosen from a phenolic resin, an epoxy resin, a urea-formaldehyde resin, an aminoplast resin, a melamine resin, an acrylated epoxy resin, a urethane resin, and mixtures thereof.

Embodiment 10 provides the shaped abrasive particle transfer assembly of any one of Embodiments 1-9, wherein the substrate is an adhesive film.

Embodiment 11 provides the shaped abrasive particle transfer assembly of Embodiment 10, wherein the adhesive film comprises one or more perforations extending between opposed first and second major surfaces of the adhesive film.

Embodiment 12 provides the shaped abrasive particle transfer assembly of any one of Embodiments 10 or 11 wherein a portion of each of the shaped abrasive particles is at least partially embedded in the adhesive film.

Embodiment 13 provides the shaped abrasive particle transfer assembly of any one of Embodiments 10-12, further comprising a release liner attached to the adhesive film.

Embodiment 14 provides the shaped abrasive particle transfer assembly of any one of Embodiments 1-13, wherein the substrate comprises a reinforcing component having the adhesive disposed thereon.

Embodiment 15 provides the shaped abrasive particle transfer assembly of Embodiment 14, wherein the reinforcing component comprises a perforated polymeric film, a perforated metal foil, a woven fabric, a knitted fabric, perforated paper, a vulcanized fiber, a nonwoven, a foam, a perforated screen, a perforated laminate, a fibrous web, or a combination thereof.

Embodiment 16 provides the shaped abrasive particle transfer assembly of Embodiment 15, wherein the fibrous web comprises a plurality of fibers forming a non-woven web, a spun-bound non-woven web, a needle-entangled non-woven web, a braided web, a knit web, a woven web, a blown microfiber, or a combination thereof.

Embodiment 17 provides the shaped abrasive particle transfer assembly of any one of Embodiments 15 or 16, wherein the fibrous web comprises a yarn comprising a plurality of the fibers.

Embodiment 18 provides the shaped abrasive particle transfer assembly of any one of Embodiments 15-17, wherein the adhesive is disposed on individual fibers of the reinforcing component.

Embodiment 19 provides the shaped abrasive particle transfer assembly of any one of Embodiments 1-18, wherein at least one of the shaped abrasive particles of the plurality of shaped abrasive particles is tetrahedral and comprises four faces joined by six edges terminating at four tips, each one of the four faces contacting three of the four faces.

Embodiment 20 provides the shaped abrasive particle transfer assembly of Embodiment 19, wherein at least one of the four faces is substantially planar.

Embodiment 21 provides the shaped abrasive particle transfer assembly of any one of Embodiments 19 or 20, wherein at least one of the four faces is concave.

Embodiment 22 provides the shaped abrasive particle transfer assembly of Embodiment 19, wherein all of the four faces are concave.

Embodiment 23 provides the shaped abrasive particle transfer assembly of any one of Embodiments 19 or 20, wherein at least one of the four faces is convex.

Embodiment 24 provides the shaped abrasive particle transfer assembly of Embodiment 19, wherein all of the four faces are convex.

Embodiment 25 provides the shaped abrasive particle transfer assembly of any one of Embodiments 19-24, wherein at least one of the tetrahedral abrasive particles has equally-sized edges.

Embodiment 26 provides the shaped abrasive particle transfer assembly of any one of Embodiments 19-24, wherein at least one of the tetrahedral abrasive particles has different-sized edges.

Embodiment 27 provides the shaped abrasive particle transfer assembly of any one of Embodiments 1-26, wherein at least one of the shaped abrasive particles of the plurality of shaped abrasive particles comprises a first side and a second side separated by a thickness t, the first side comprises a first face having a triangular perimeter and the second side comprises a second face having a triangular perimeter, wherein the thickness t is equal to or smaller than the length of the shortest side-related dimension of the particle.

Embodiment 28 provides the shaped abrasive particle transfer assembly of Embodiment 27, further comprising at least one sidewall connecting the first side and the second side.

Embodiment 29 provides the shaped abrasive particle transfer assembly of Embodiment 28, wherein the at least one sidewall is a sloping sidewall.

Embodiment 30 provides the shaped abrasive particle transfer assembly of any one of Embodiments 28 or 29, wherein a draft angle $\alpha$ of the sloping sidewall is in a range of from about 95 degrees and about 130 degrees.

Embodiment 31 provides the shaped abrasive particle transfer assembly of any one of Embodiments 28-30, wherein the first face and the second face are substantially parallel to each other.

Embodiment 32 provides the shaped abrasive particle transfer assembly of any one of Embodiments 28-31, wherein the first face and the second face are substantially non-parallel to each other.

Embodiment 33 provides the shaped abrasive particle transfer assembly of any one of Embodiments 28-32, wherein at least one of the first and the second face are substantially planar.

Embodiment 34 provides the shaped abrasive particle transfer assembly of any one of Embodiments 28-33, wherein at least one of the first and the second face is a non-planar face.

Embodiment 35 provides the shaped abrasive particle transfer assembly of any one of Embodiments 1-34, wherein at least one of the shaped abrasive particles comprises at least one shape feature comprising: an opening, a concave surface, a convex surface, a groove, a ridge, a fractured surface, a low roundness factor, or a perimeter comprising one or more corner points having a sharp tip.

Embodiment 36 provides the shaped abrasive particle transfer assembly of any one of Embodiments 1-35, wherein the predetermined pattern comprises a plurality of circles.

Embodiment 37 provides the shaped abrasive particle transfer assembly of any one of Embodiments 1-36, wherein the predetermined pattern comprises a plurality of substantially parallel lines.

Embodiment 38 provides the shaped abrasive particle transfer assembly of any one of Embodiments 1-37, wherein a z-direction rotational angle about a line perpendicular to a major surface of the substrate and passing through individual shaped abrasive particles of the plurality of shaped abrasive particles is substantially the same for at least a portion of the plurality of shaped abrasive particles.

Embodiment 39 provides the shaped abrasive particle transfer assembly of Embodiment 38, wherein the portion of the shaped abrasive particles having substantially the same z-direction rotational angle are in a range of from about 25 wt % to about 100 wt % of the plurality of shaped abrasive particles.

Embodiment 40 provides the shaped abrasive particle transfer assembly of any one of Embodiments 38 or 39, wherein the portion of the shaped abrasive particles having substantially the same z-direction rotational angle are in a range of from about 50 wt % to about 80 wt % of the plurality of shaped abrasive particles.

Embodiment 41 provides the shaped abrasive particle transfer assembly of any one of Embodiments 1-40, wherein at least some of the plurality of shaped abrasive particles comprise a ceramic material, a polymeric material, or a mixture thereof.

Embodiment 42 provides the shaped abrasive particle transfer assembly of any one of Embodiments 1-41, wherein at least some of the plurality of shaped abrasive particles comprise alpha alumina, sol-gel derived alpha alumina, or a mixture thereof.

Embodiment 43 provides the shaped abrasive particle transfer assembly of any one of Embodiments 1-42, wherein at least some of the plurality of shaped abrasive particles comprise an aluminosilicate, an alumina, a silica, a silicon nitride, a carbon, a glass, a metal, an alumina-phosphorous pentoxide, an alumina-boria-silica, a zirconia, a zirconia-alumina, a zirconia-silica, a fused aluminum oxide, a heat-treated aluminum oxide, a ceramic aluminum oxide, a sintered aluminum oxide, a silicon carbide material, titanium diboride, boron carbide, tungsten carbide, titanium carbide, diamond, cubic boron nitride, garnet, fused alumina-zirconia, cerium oxide, zirconium oxide, titanium oxide, or a combination thereof.

Embodiment 44 provides a method of making the shaped abrasive particle transfer assembly of any one of Embodiments 1-43 the method comprising:

contacting the substrate with the plurality of shaped abrasive particles to adhere the plurality of shaped abrasive particles to the substrate.

Embodiment 45 provides the method of Embodiment 44, wherein the plurality of shaped abrasive particles are retained in individual cavities of a production tool before contacting the substrate with the plurality of shaped abrasive particles.

Embodiment 46 provides the method of Embodiment 45, wherein the individual shaped abrasive particles are retained in the individual cavities via a vacuum, via gravity, an electrostatic interaction, or engagement with a retaining member.

Embodiment 47 provides the method of Embodiment 46, wherein the individual shaped abrasive particles are released from the production tool by releasing the vacuum, inverting the production tool, changing the electrostatic interaction, disengaging the retaining member, or a combination thereof.

Embodiment 48 provides the method of any one of Embodiments 44 or 45, wherein the cavities together have a pattern that substantially conforms to the predetermined pattern of the individual shaped abrasive particles.

Embodiment 49 provides the method of any one of Embodiments 45-48, wherein a gap between the substrate and the retained shaped abrasive particles is in a range of from about 0.01 μm to about 1270 μm.

Embodiment 50 provides the method of any one of Embodiments 45-49, wherein a gap between the substrate and the retained shaped abrasive particles is in a range of from about 0.01 μm to about 254 μm.

Embodiment 51 provides the method of any one of Embodiments 44-50, further comprising applying a release liner to the substrate.

Embodiment 52 provides the method of Embodiment 51, wherein the release liner comprises a polyethylene, a polypropylene, a polyurethane, or a mixture thereof.

Embodiment 53 provides the method of any one of Embodiments 44-52, further comprising perforating the substrate.

Embodiment 54 provides the method of any one of Embodiment 44-53, further comprising drying the substrate.

Embodiment 55 provides the method of any one of Embodiments 44-54, further comprising stretching the shaped abrasive particle transfer assembly.

Embodiment 56 provides a coated abrasive article comprising a backing defining a major surface; and the shaped abrasive particle transfer assembly of any one of Embodiments 1-43 or formed according to the method of any one of Embodiments 44-55, attached to the backing by a make coat.

Embodiment 57 provides the coated abrasive article of Embodiment 56, wherein the backing is a flexible backing.

Embodiment 58 provides the coated abrasive article of any one of Embodiments 56 or 57, wherein the backing comprises at least one material chosen from a polymeric film, a metal foil, a woven fabric, a knitted fabric, paper, vulcanized fiber, a staple fiber, a continuous fiber, a nonwoven, a foam, a screen, and a laminate.

Embodiment 59 provides the coated abrasive article of any one of Embodiments 56-58, wherein the make coat comprises a resinous adhesive.

Embodiment 60 provides the coated abrasive article of Embodiment 59, wherein the resinous adhesive comprises one or more resins chosen from a phenolic resin, an epoxy resin, a urea-formaldehyde resin, an acrylate resin, an aminoplast resin, a melamine resin, an acrylated epoxy resin, a urethane resin, and mixtures thereof.

Embodiment 61 provides the coated abrasive article of any one of Embodiments 56-60, wherein the adhesive of the shaped abrasive particle transfer assembly and the resinous adhesive comprise the same material or mixture of materials.

Embodiment 62 provides the coated abrasive article of any one of Embodiments 56-61, wherein the abrasive articles further comprises a plurality of crushed abrasive particles adhered to the make coat.

Embodiment 63 provides the coated abrasive article of Embodiment 62, wherein the crushed abrasive particles range from about 5 wt % to about 96 wt % of the abrasive layer.

Embodiment 64 provides the coated abrasive article of any one of Embodiments 62 or 63, wherein the crushed abrasive particles range from about 15 wt % to about 50 wt % of the abrasive layer.

Embodiment 65 provides the coated abrasive article of any one of Embodiments 56-64, wherein the shaped abrasive particles range from about 5 wt % to about 96 wt % of the abrasive layer.

Embodiment 66 provides the coated abrasive article of any one of Embodiments 56-65, wherein the shaped abrasive particles range from about 15 wt % to about 50 wt % of the abrasive layer.

Embodiment 67 provides the coated abrasive article of any one of Embodiments 56-66, wherein the abrasive article is a grinding wheel or a portion thereof.

Embodiment 68 provides the coated abrasive article of Embodiment 67, wherein the grinding wheel is a depressed-center grinding wheel or a portion thereof.

Embodiment 69 provides the coated abrasive article of any one of Embodiments 56-68, wherein the abrasive article is a cut-off wheel or a portion thereof.

Embodiment 70 provides the coated abrasive article of any one of Embodiments 56-69, wherein the abrasive article is a belt or a portion thereof.

Embodiment 71 provides a method of making the coated abrasive article of any one of Embodiments 56-70, the method comprising:

adhering the shaped abrasive particle transfer assembly to the backing; and drying the make coat.

Embodiment 72 provides the method of Embodiment 71, wherein the shaped abrasive particle transfer assembly is at least partially immersed in the make coat.

Embodiment 73 provides the method of any one of Embodiments 71 or 72, wherein the make coat is distributed over a portion of the first and second major surface of the shaped abrasive particle transfer assembly.

Embodiment 74 provides the method of any one of Embodiments 71-73, wherein the make coat flows through perforations of the shaped abrasive particle transfer assembly, spaces between fibers of the shaped abrasive particle transfer assembly, or both.

Embodiment 75 provides the method of any one of Embodiments 71-74, further comprising heating the make coat to a temperature in a range of from about 20° C. to about 220° C.

Embodiment 76 provides the method of any one of Embodiments 71-75, further comprising heating the make coat to a temperature in a range of from about 100° C. to about 150° C.

Embodiment 77 provides the method of any one of Embodiments 71-76, further comprising thermally degrading the reinforcing component.

Embodiment 78 provides the method of any one of Embodiments 71-77, wherein a belt driven by a first roller comprises the shaped abrasive particle transfer assembly;

a belt driven by a second roller comprises the backing; and the shaped abrasive particle transfer assembly and the backing are driven to contact each other by the first roller and the second roller.

Embodiment 79 provides a method of using the coated abrasive article of any one of Embodiments 56-70 or made according to the method of any one of Embodiments 71-78, the method comprising:

moving at least one of the coated abrasive article and the workpiece relative to one another while in contact with one another to remove at least a portion of the workpiece.

What is claimed is:

1. A method of making a coated abrasive article, the method comprising:

filling cavities of a production tool with a plurality of shaped abrasive particles such that the shaped abrasive particles are retained in individual cavities of the production tool in a predetermined pattern;

making a shaped abrasive particle transfer assembly by:

contacting a substrate comprising an adhesive coated porous reinforcing component to the plurality of shaped abrasive particles that are retained in the individual cavities of the production tool to adhere the plurality of shaped abrasive particles to the substate in the predetermined pattern; and releasing the plurality of shaped abrasive particles from the cavities of the production tool;

wherein the shaped abrasive particle transfer assembly comprises first and second major surfaces;

transferring the shaped abrasive particle transfer assembly to a backing comprising a make coat;

adhering the shaped abrasive particle transfer assembly by allowing the make coat to flow through the adhesive coated porous reinforcing component between the first and second major surfaces of the shaped abrasive particle transfer assembly; and drying the make coat to form the coated abrasive article having the plurality of shaped abrasive particles in the predetermined pattern.

2. The method of claim 1, wherein the shaped abrasive particle transfer assembly is at least partially immersed in the make coat.

3. The method of claim 1, wherein the make coat is distributed over a portion of the first and second major surface of the shaped abrasive particle transfer assembly.

4. The method of claim 1, wherein the make coat flows through perforations of the shaped abrasive particle transfer assembly, spaces between fibers of the shaped abrasive particle transfer assembly, or both.

5. The method of claim 1, wherein the individual shaped abrasive particles are retained in the production tool by vacuum, gravity, electrostatic interaction, a retaining member, or a combination thereof.

6. The method of claim 2, wherein the individual shaped abrasive particles are released from the production tool by releasing the vacuum, inverting the production tool, changing the electrostatic interaction, disengaging the retaining member, or a combination thereof.

* * * * *